US007520631B2

(12) United States Patent
Dalton et al.

(10) Patent No.: US 7,520,631 B2
(45) Date of Patent: Apr. 21, 2009

(54) LIGHTING DEVICE

(75) Inventors: David R. Dalton, Turramurra (AU); John R. Brown, Mosman (AU); Timothy J. Rugendyke, Woy Woy (AU)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 11/633,746

(22) Filed: Dec. 5, 2006

(65) Prior Publication Data

US 2007/0076411 A1 Apr. 5, 2007

Related U.S. Application Data

(63) Continuation of application No. 10/481,374, filed as application No. PCT/AU02/00720 on Jun. 4, 2002, now Pat. No. 7,188,967.

(30) Foreign Application Priority Data

Jun. 18, 2001 (AU) ..... PR5749

(51) Int. Cl.
*F21L 4/04* (2006.01)

(52) U.S. Cl. ..... 362/205; 362/186; 362/154

(58) Field of Classification Search ..... 362/145, 362/186, 154, 253
See application file for complete search history.

(56) References Cited

U.S. PATENT DOCUMENTS 4,410,930 A * 10/1983 Yachabach ..... 362/145
4,460,941 A 7/1984 Miller
5,183,324 A 2/1993 Thomas
5,318,177 A 6/1994 Isacson
5,560,705 A 10/1996 Shiau
5,590,951 A 1/1997 Matthews
6,030,094 A 2/2000 Sedovic et al.
6,361,183 B1 3/2002 Maglica
6,402,338 B1 * 6/2002 Mitzel et al. ..... 362/154
7,188,967 B2 * 3/2007 Dalton et al. ..... 362/205

FOREIGN PATENT DOCUMENTS

CN 86207447 U 8/1988
CN 2050247 U 12/1989

OTHER PUBLICATIONS

Office Action from People's Republic of China for Application No. 200510116315.3, filed Jun. 4, 2002, mailed Mar. 7, 2008, 9 pages.
Supplementary European Search Report for Application EP 02 73 4900, European Patent Office, 1 pg.

* cited by examiner

*Primary Examiner*—Anabel M Ton
(74) *Attorney, Agent, or Firm*—Gregory J. Adams

(57) ABSTRACT

The present invention provides a lighting device having a battery housing to hold a battery, a light housing having a light source and a lens assembly into which said light source will emit light when activated, said battery and said light source being in circuit with a switch to open and close said circuit, said light housing being moveable relative to said battery housing to motivate said switch to open and/or close said circuit.

20 Claims, 6 Drawing Sheets

LIGHTING DEVICE

RELATED APPLICATIONS

This application is a continuation of application Ser. No. 10/481,374 filed Jun. 1, 2004, now U.S. Pat. No. 7,188,967 which is the National Stage of International Application No. PCT/AU 02/00720, filed 4 Jun. 2002, which claims the benefit of Australian Application No. AU PR 5749, filed 18 Jun. 2001.

FIELD OF THE INVENTION

The present invention relates to outdoor lighting devices, particularly such as those used in gardens or to mark trails.

BACKGROUND OF THE INVENTION

There has been a long felt need for a garden light having a relatively long run time, which is also battery operated, and is relatively inexpensive to manufacture.

SUMMARY OF THE INVENTION

The present invention provides a lighting device having a battery housing to hold a battery, a light housing having a light source and a lens assembly into which said light source will emit light when activated, said battery and said light source being in circuit with a switch to open and close said circuit, said light housing being moveable relative to said battery housing to motivate said switch to open and/or close said circuit.

The light housing is preferably a part of or is connected to an intermediate body portion. The intermediate body portion is slidably connected to said battery housing. The light housing or the intermediate body portion is preferably biased away from said battery housing with the bias being produced by a compression spring.

The battery housing can include an elongated switch engagement member. The intermediate body portion preferably houses a printed circuit board on which is mounted the light source and switch. The lens assembly can include a reflector around the light source. Preferably a second reflector is located away from said light source. Preferably the lens assembly includes a cylindrical lens. The cylindrical lens can have its internal surfaces frosted to assist the diffusion of light over the surface of the lens. The outside surface of the cylindrical lens can include striations or lenticules therearound.

The light housing and battery housing can be elongated. The battery housing can include a screw-on cover to access the internal portions of the battery housing. The base preferably includes a recess to receive a mounting spike. The base can also be adapted to be received by an attachable foot.

Movement of the light housing relative to the battery housing is preferably limited. The limitation of movement is preferably by means of parts of the intermediate body portion engaging formations on the battery housing.

The intermediate body portion can include at least two shoulders to engage the battery housing at two spaced locations preferably the shoulders one annular or port annular. Preferably the light source is an LED or low wattage lamp and preferably the battery is of a D size. A cap can be positioned over the lens assembly to assist in maintaining structural integrity and water resistance.

In a further preferred embodiment the circuit of the lighting device further includes a light sensitive element adapted to detect an ambient light level, and wherein said light source is illuminated in response to said detected ambient light level.

Preferably the said light source is deactivated if the detected ambient light level is above a predetermined ambient light threshold. Preferably the light source is illuminated if the detected ambient light level is below a predetermined ambient light threshold.

Preferably the light sensitive element is selected from the following light sensitive elements:

a light dependent resistor, a photodiode or a phototransistor.

Preferably the brightness of said light source is varied in response to said detected ambient light level. In use when the detected ambient light level falls within a predetermined range of ambient light levels the brightness of said light source can be either increased or decreased when said ambient light level increases. In use when the detected ambient light level falls within a predetermined range of ambient light levels the brightness of said light source can be either increased or decreased when said ambient light level decreases.

BRIEF DESCRIPTION OF THE DRAWINGS

An embodiment of the present invention will now be described, by way of example only, with reference to the accompanying drawings in which.

DETAILED DESCRIPTION OF THE EMBODIMENTS

Figure 1:
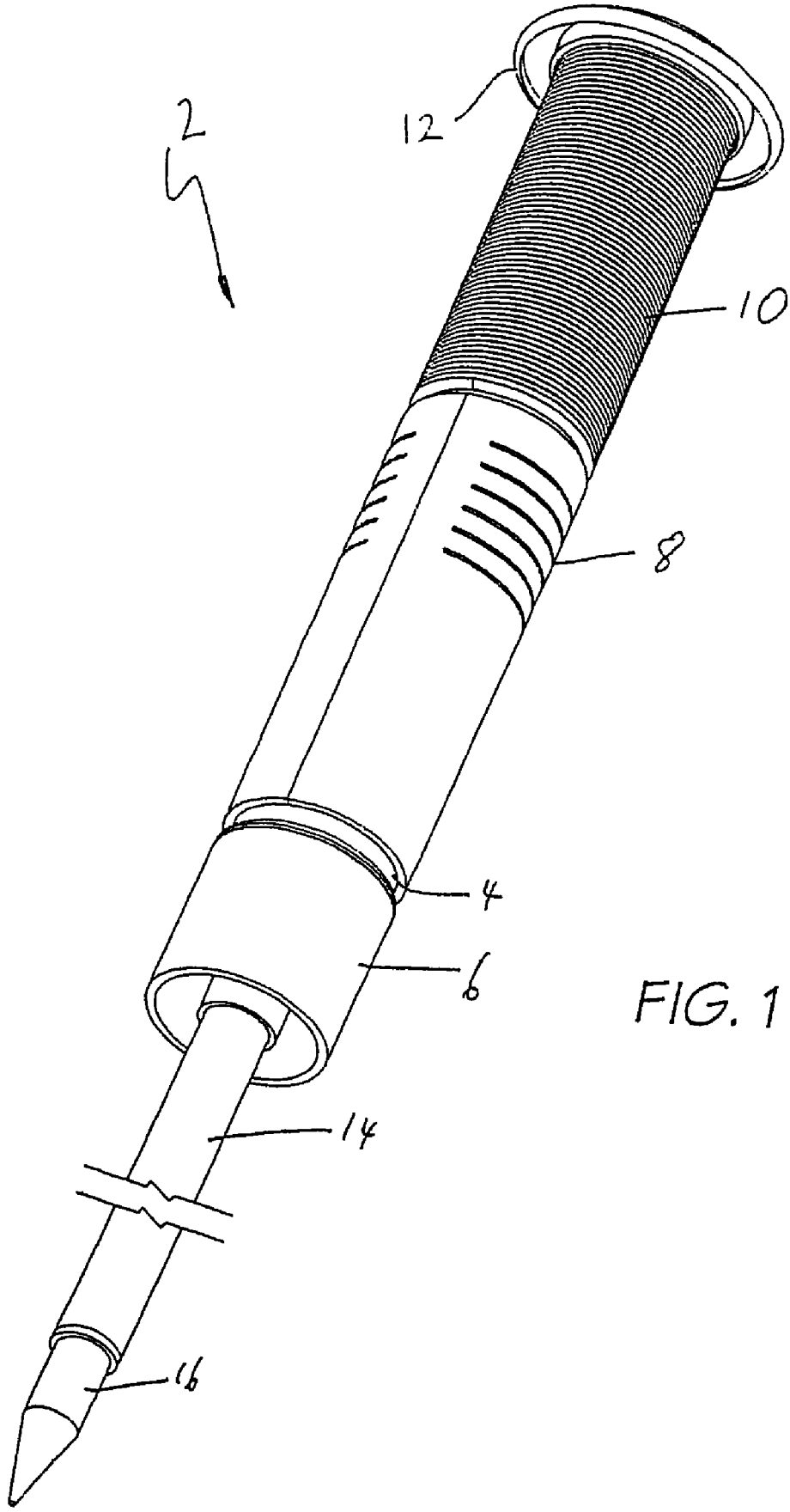
FIG. 1 is a perspective view of an outdoor light with a spike base.

As illustrated in FIG. 1, an outdoor light 2 which is cylindrical in construction, has a battery housing 4, a battery housing cover 6, an intermediate body portion 8, which is slidably connected to the battery housing 4 and a light housing 10 which is secured to the intermediate body portion 8, each of which will be described in more detail later. The intermediate body portion 8 is illustrated as being separate from and joined to the light housing 10. If desired the intermediate body portion 8 and the light housing 10 can be integrally formed.

At the top of the light housing 10 is a cap 12. The battery housing cover 6 has depending therefrom a mounting spike 14 which terminates in a pointed head 16. The mounting spike 14 is indicated in FIG. 1 as discontinuous so as to indicate that one or more such spikes can be joined together to form the mounting spike.

Figure 2:
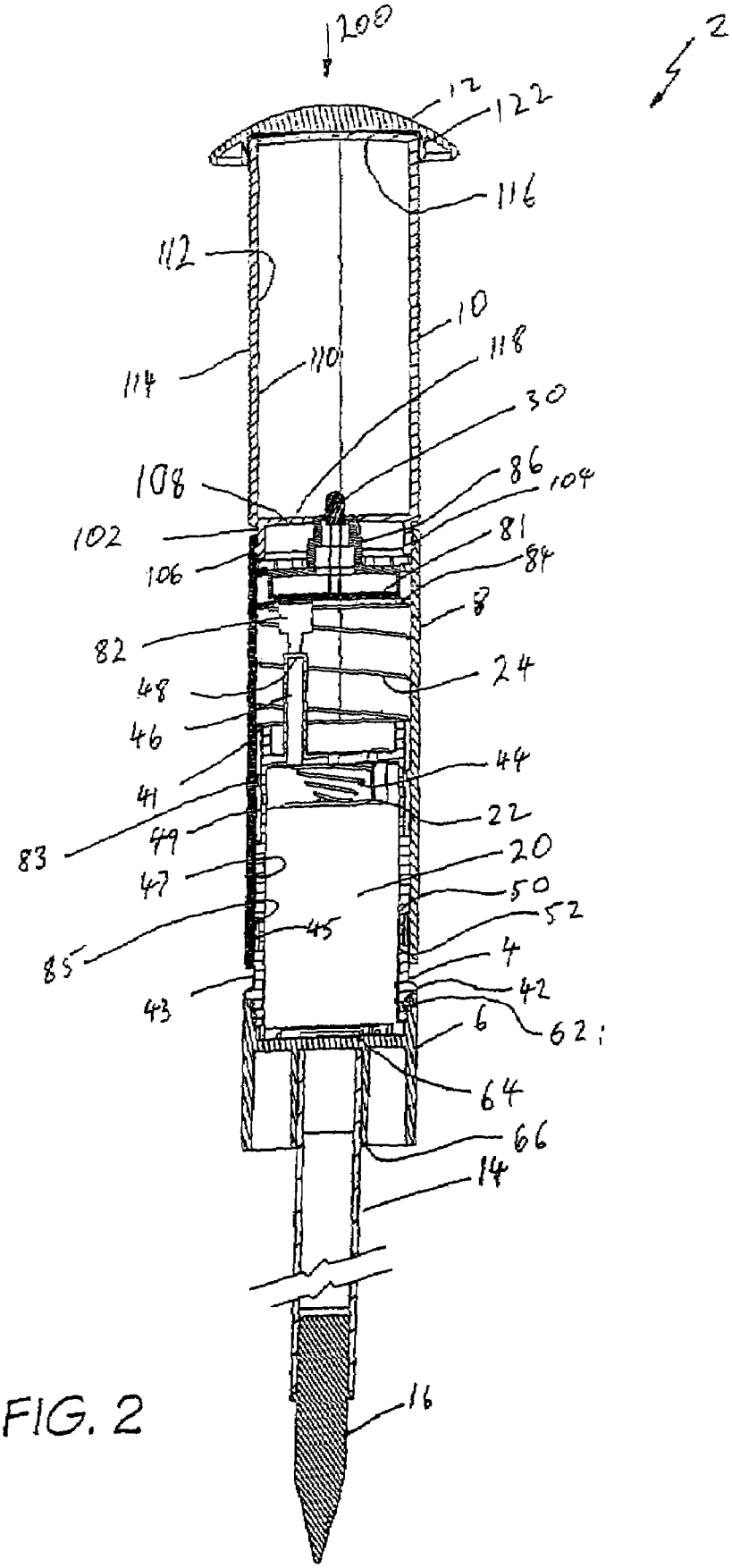
FIG. 2 is a cross-section through the outdoor light of FIG. 1.

As illustrated in FIG. 2 in cross-section, the battery housing 4 has at its lowest end, a male thread 42, which receives a female thread 62 of the battery housing cover 6. The battery housing 4 at its upper end includes a spring contact 44 for engaging the negative terminal 22 of a D size dry cell or battery 20. A wire (not illustrated) connects the spring contact 44 to a printed circuit board 81.

The battery housing 4 includes at its upper end an elongated switch contact column 46 which terminates in a flat contacting surface 48 to engage a switch 82 mounted on the underside of printed circuit board 81.

Beneath the surface 48 and around the column 46 is a flange 41 to provide a bearing surface against which compression spring 24 can act.

The cylindrical outer surface of the battery housing 4 includes annular surfaces 43, 45, 47 and 49 which provide bearing surfaces against which parts of the intermediate body portion 8 can bear and slide. As can be seen from FIG. 2, the bearing surfaces 45 and 49 are recessed relative to the surfaces 43 and 47. The intermediate body portion 8 has corresponding radially inwardly directed flanges 83 and 85. The change of section from the surfaces 45 to 47, and 45 to 43 respectively produces an upper shoulder 50 and a lower shoulder 52 between which the flange 85 can move. The upper shoulder 50 between surfaces 45 and 47, limits the intermediate body portion 8 in the upward direction, whilst the lower shoulder 52 (being the shoulder formed between the surfaces 43 and 45) limits the downward movement of the intermediate body portion 8 relative to the battery housing 4.

The internal cylindrical surface of the intermediate body portion 8, together with flanges 83 and 85 engage and slide relative to the annular surfaces 43, 45, 47 and 49 making the slidable interconnection between the battery housing 4 and intermediate body 8 structurally sound for the purposes to which the outdoor light 2 will be put, whilst achieving slidable relative movement between the two components.

The battery housing cover 6 includes a positive battery contact 64 which makes contact with a metal contact (not illustrated) contained within the battery housing 4. The opposite end of this contact, within the battery housing 4 is connected by a wire (not illustrated) to the printed circuit board 81.

The screwed connection of the battery housing cover 6 to the battery housing 4 helps to prevent ingress of water from this connection.

The battery housing cover 6 includes in its lower portions a central, cylindrical wall 66 which receives in the internal portions thereof, the outside diameter of the mounting spike 14. The mounting spike 14 receives in its proximal end a pointed head 16.

The upper portion of the intermediate body 8 includes radially inwardly directed shoulders 84 which support the printed circuit board 81. The printed circuit board 81 is held against the shoulder 84 by means of a shaped LED support 86 which helps to prevent the LED from laterally moving relative to the printed circuit board 81. The LED 30 extends from the printed circuit board 81 so that the diode of the LED extends into the light housing 10.

The light housing 10 at its base 102 is held by means of a shoulder 104 in a groove 106 on the intermediate body 8. An internal wall 108 surrounds the LED support 86 and clamps the LED support 86 and printed circuit board 81 into position as illustrated in FIG. 2. A locator or index means (not illustrated) is provided either on the printed circuit board 81 or LED support 86 so that when assembled, the switch 82 is coaxial with the column 46 on battery housing 4.

The upper portion of the light housing 10 is a lens assembly 110. The lens assembly 110 is made from a transparent or translucent material with the internal wall 112 having a frosted finish to help diffuse light over the cylindrical surface of the lens assembly 110.

The external surface of the lens assembly 110 is made up of striations or lenticules 114 which are generally annular in nature and surround the external surface of the lens assembly 110. The upper end of the lens assembly 110 includes a reflector surface 116 whilst the internal face 118 of the surface 108 is also a reflector surface. Thus any light emitted by the LED 30 will reflect off the surfaces 118 and 116 which helps to reflect light through the cylindrical wall of the lens assembly 110.

The cap 12 has a cylindrical recess 122 to receive the upper end of the lens assembly 110. The lens assembly 110 and the intermediate body 8 are made from two halves which are sonically welded together. However, for structural integrity, the cap 12 is positioned by means of a compressed fit and/or sonically welded to the lens assembly 110 thus helping to keep the lens assembly 110 as an integral unit.

In use, the outdoor light 2 is assembled by first pushing the mounting spike 14 with pointed head 16 into the ground. If desired, additional mounted spikes 14 and pointed heads 16 can be added end on end to produce a conjoined mounting spike of a desired height. Once the mounting spike 14 is in the ground, an assembly of the battery cover 6, battery housing 4, intermediate body portion 8, lens assembly 10 and cap 12 is positioned onto the mounting spike 14 by sliding the cylindrical recess formed by cylindrical wall 66 over the upper end of mounting spike 14.

Once fully assembled, the outdoor light 2 can be switched on by pushing downwardly in the direction of arrow 200 against the cap 12 which will force the light housing 10 and intermediate body portion 8 to move relative to the battery housing 4 against the bias of spring 24, thereby pushing the switch 82 against the surface 48 atop of the column 46. This downward action will close the circuit if it is open thus illuminating the LED 30 and the lens assembly 110. To switch off the outdoor light 2, the cap 12 is pushed in the direction of arrow 200 to open the circuit.

In another embodiment, the outdoor light 2 can include circuitry to switch off the LED 30 as the level of ambient light increases. Such a light sensitive embodiment will include at least one light detector, such as a light dependent resistor (LDR), photodiode, phototransistor, or other optically sensitive circuit component. The light detector(s) is mounted on the light 2, such that it is able to detect the level of ambient light in the vicinity of the outdoor light 2.

In order to prevent the light emitted from the outdoor light 2 activating the light detector and turning the LED 30 off, the light detector should be mounted such that the light omitted from the LED 30 does not impinge upon it, for example by mounting the light detector facing upward on the top face of cap 12, or on the lower end of the intermediate body portion 8. Other measures to prevent the LED 30 activating the light detector may also be employed, such as selecting the LED 30 or light detector such that the omission spectrum of the LED 30 falls outside the response spectrum of the light detector. The sensitivity of the light detector, or associated circuitry, can also be selected such that the light emitted by the LED 30 of the outdoor light 2, or an adjacent outdoor light of the same type, does not activate the power down mode.

It is envisaged that by selecting appropriate circuitry the light sensitive power down mode can operate to turn the LED 30 off when the ambient light reaches a particular intensity. Advantageously, once the user has placed their outdoor light 2 in the ground and activated it by pushing down on the cap 12, the user then does not need to turn the light off. This will automatically occur when the sun comes up or a brighter light source is used to illuminate an area. In either case, the use of the outdoor light in bright conditions would be unnecessary and lead to an unwanted drain on the light's batteries.

Alternatively the light detector could be configured to switch the LED 30 on and off as appropriate as the ambient light changes. Thus once the user has placed their outdoor light 2 in the ground and activated it by pushing down on the cap 12 the LED will come on and turn off as required. This embodiment is particularly advantageous when setting up the outdoor light during the day, for use during the night. Thus the outdoor light can be placed in a desired position and activated, but will not turn on the LED until the sun sets, thus allowing early activation of the light, without unnecessary use of the battery's power while the sun is up when the outdoor light will have limited effect.

In a further embodiment, the circuit and light detector can be configured to control the intensity of the LED's 30 output to compensate for changes in ambient light. This embodiment is similar to that described above. However, rather than simply using the light detector to turn the LED on or off, the circuit is configured such that the light emitted by LED 30 ramps down as the ambient light increases, or ramps up as the ambient light decreases. A combination of the two modes of operation can also be used. In such an embodiment the LED is not illuminated until the ambient light falls below a predetermined threshold, but once the LED is illuminated, its intensity is varied to compensate for changes in ambient light. If the ambient light increases over a predetermined level the LED is deactivated.

Alternatively, the variation in illumination intensity of the LED may be varied so that over a predetermined range of ambient light levels the brightness of the light source increases with increasing ambient light levels, so as to render the brightness of the LED as perceived by a viewer, to be constant. This mode of operation may be particularly advantageous if the outdoor light is being used to mark a path, walkway or the like, and it is necessary to ensure the pathway can be easily discerned in conditions of varying light.

Figure 3:
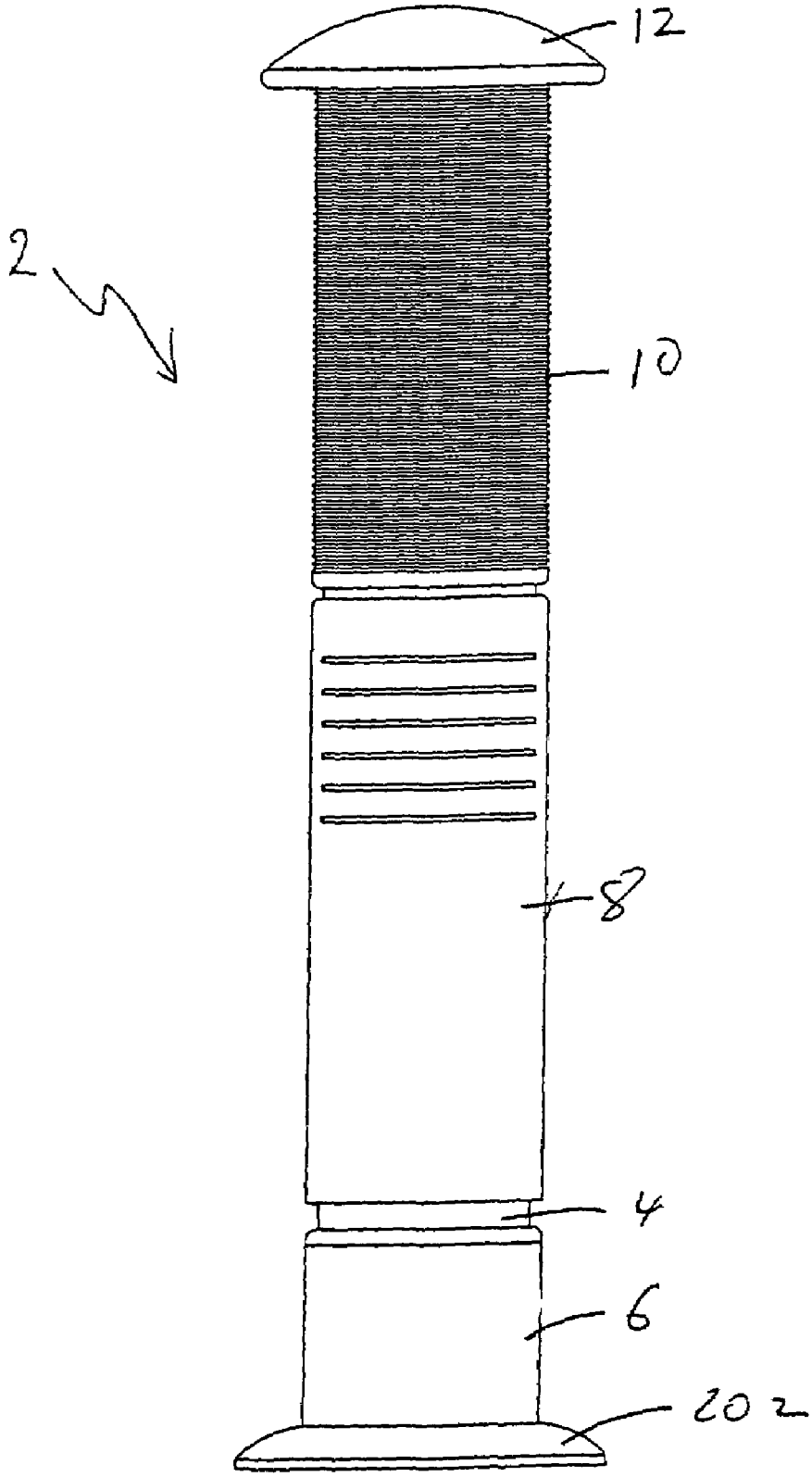
FIG. 3 is a front elevation of an outdoor light similar to that of FIG. 1 with an attached foot instead of a spike base.
Figure 4:
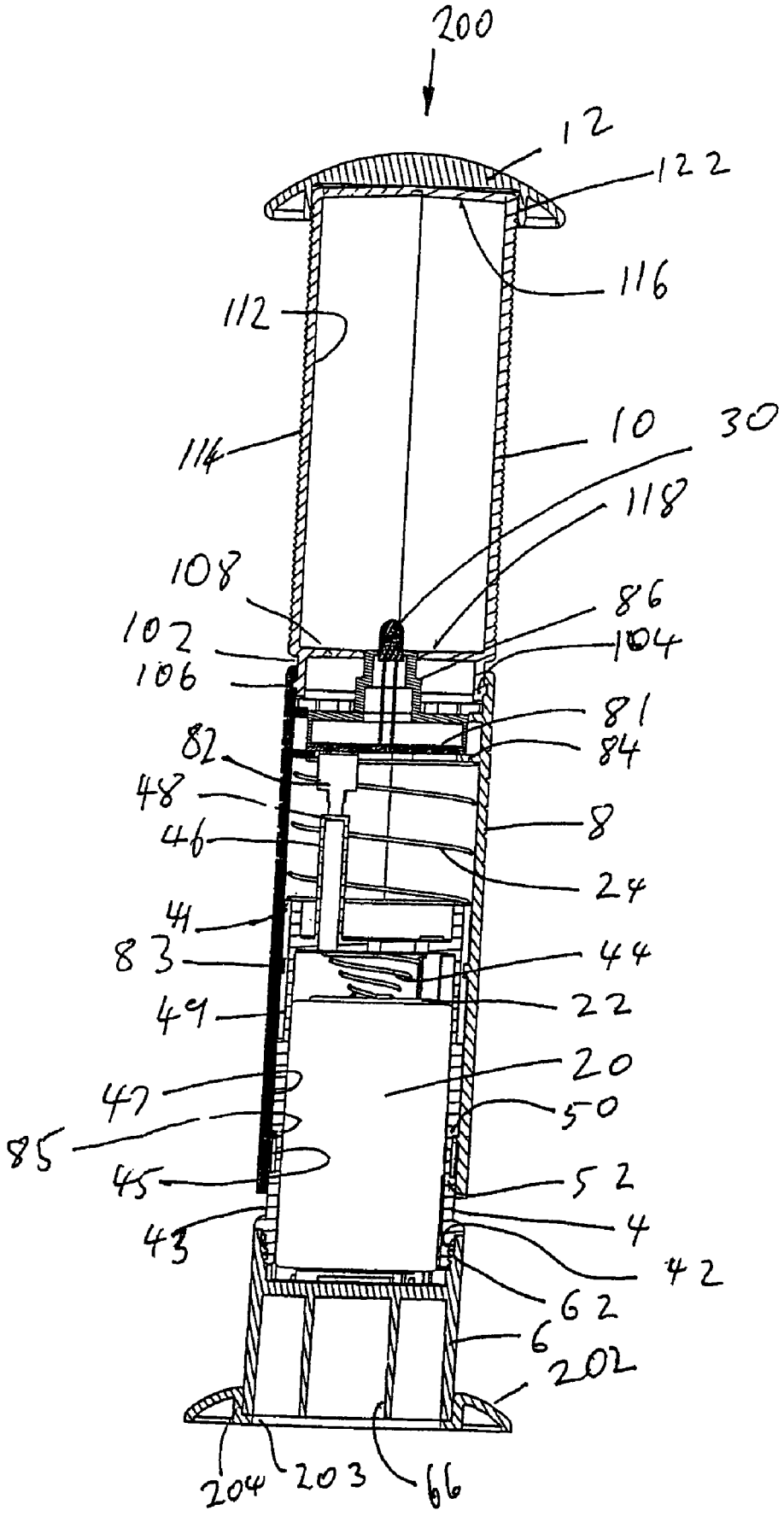
FIG. 4 is a cross-section through the light of FIG. 3.

Illustrated in FIGS. 3 and 4 is the outdoor light 2 similar to that of FIG. 2 except that the mounting spike 14 has been removed and an annular foot 202 added. The annular foot 202 has a central aperture 203 and a cylindrical recess 204 to receive the outside diameter of the cylindrical skirt of the battery housing cover 6. The annular foot 202 provides added stability allowing the outdoor light 2 when combined with a foot 202 to be placed onto a path, deck, patio or the like. The central aperture 203 allows access to the cylindrical wall 66, when the foot 202 is in position. Thus, a user can still position the combined outdoor light 2 and foot 202 onto a mounting spike.

Figure 6:
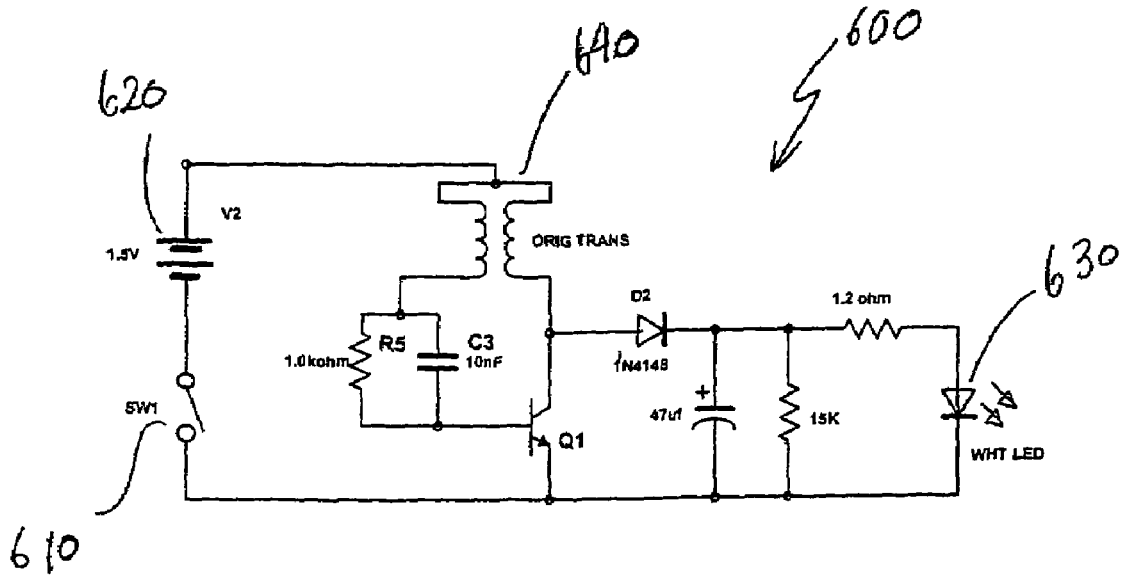
FIG. 6 shows a schematic representation of a circuit suitable for use in the outdoor light of FIGS. 1 to 5.
Figure 7:
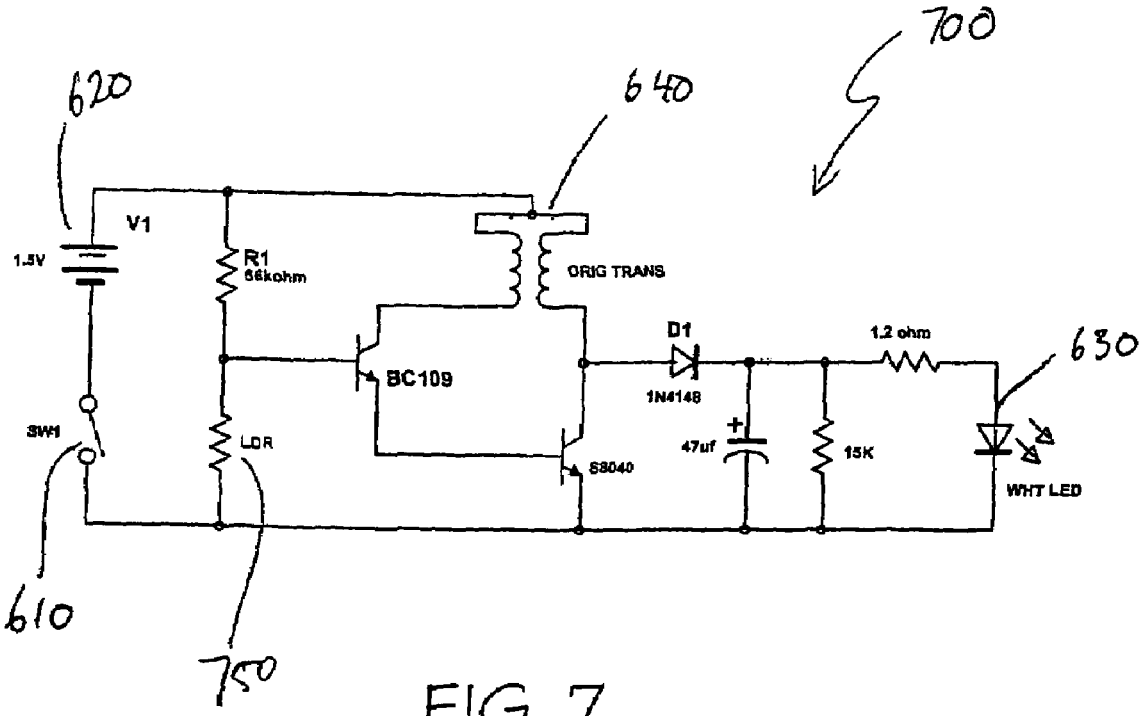
FIG. 7 shows a schematic representation of a circuit suitable for use in an outdoor light which is adapted to turn itself off during the day.

FIGS. 6 and 7 show suitable circuits for use in an outdoor light as described above. As will be appreciated by those skilled in the art the circuit 600 is powered by a DC power source 620 (which corresponds to dry cell 20 of FIG. 2) and includes a switch 610 (which corresponds to switch 82 of FIG. 2), and a white LED 630 (corresponding to LED 30 of FIG. 2). The circuit additionally includes transformer 640 which is used to step up the voltage from 1.5 volts, as output from the power source 620, to 3.6 volts, which is required to illuminate the white LED 630. As described above a user of the outdoor light can then close the switch 620 of the circuit by pushing down on the cap (12 in FIG. 2) of the light. This completes the circuit and illuminates the LED 630.

FIG. 7 shows a circuit 700 for use in a light sensitive embodiment of the present invention. The circuit 700 differs from the circuit 600 of FIG. 6 in that, in addition to a power source 620, a switch 610, a transformer 640, and white LED 630 the circuit 700 includes a light dependent resistor 750. The light dependent resistor (LDR) 750 is configured to increase in resistance when exposed to light. Thus, when the LDR 750 is exposed to light, eg. during the day, the LDR's 750 resistance increases and causes the transistor BC109 to shut off current to transistor S8040 thereby shutting turning off LED 630. It should be noted that exposing the LDR 750 to light does not break the circuit by opening the switch 610, but rather by preventing current flow through the transistors BC109 and S8040. Thus once the garden light is activated, as described above by pushing down on cap 12, the circuit 700 is continually discharging power, irrespective of whether the LED 630 is illuminated or not, until the switch is opened. However, the rate of discharge of the circuit 700 in bright conditions with the LED 630 not illuminated is less than the self-discharge rate of the circuit 600 shown in FIG. 6 when its switch 610 is open. Thus the circuit 700 does not result in any unnecessary discharge of power while the white LED is not emitting light despite the circuit being closed.

Figure 5:
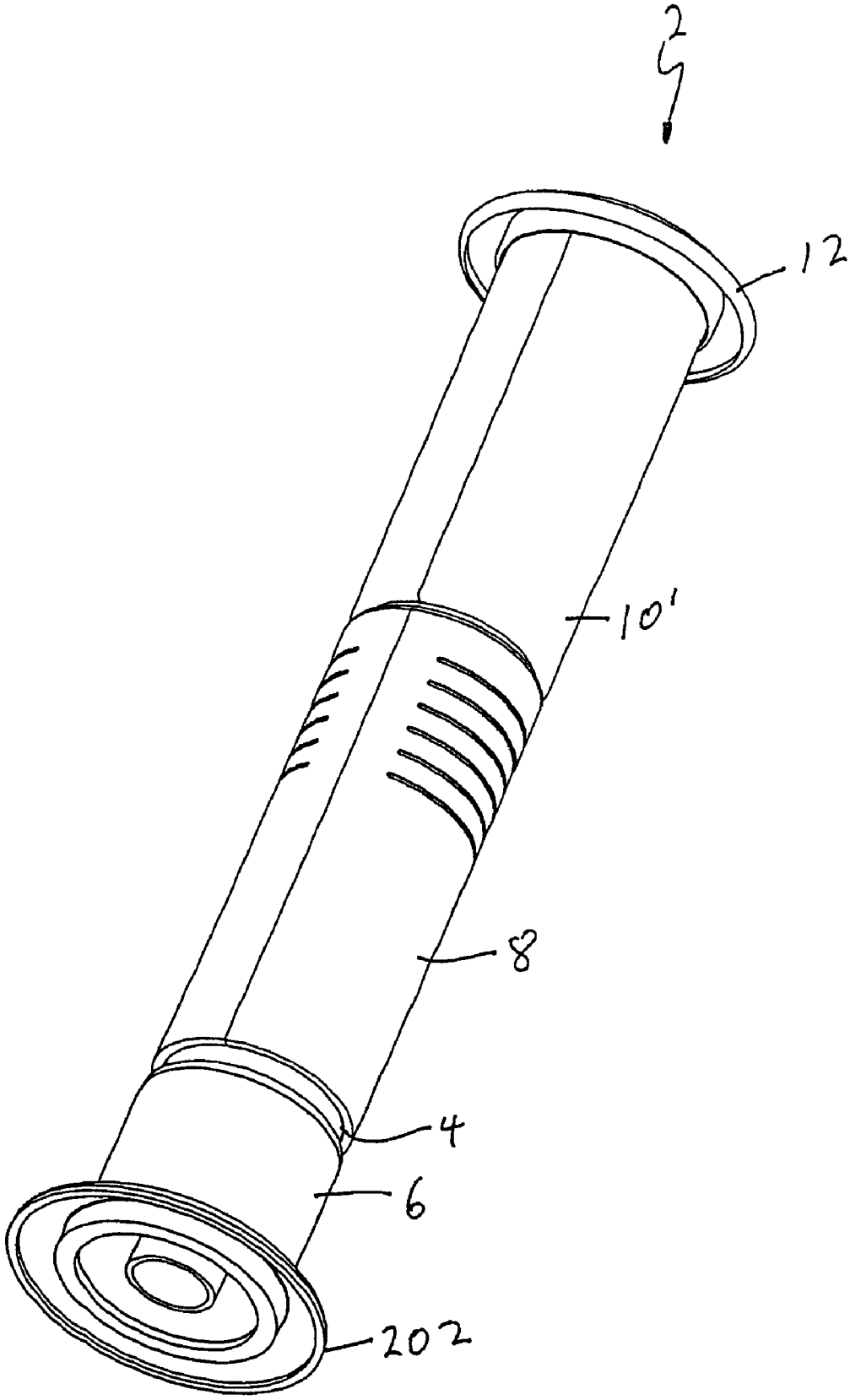
FIG. 5 is a perspective view of an outdoor light similar to that of FIG. 1.

In FIGS. 1 to 4 the external surface of the lens assembly 110 is made up of circumferential striations or lenticules 114 which are generally annular in nature and surround the external surface of the lens assembly 110. These are can be replaced by a lens assembly 10' which does not include such lenticules as is illustrated in the outdoor light 2 of FIG. 5.

It will be understood that the invention disclosed and defined herein extends to all alternative combinations of two or more of the individual features mentioned or evident from the text or drawings. All of these different combinations constitute various alternative aspects of the invention.

The foregoing describes embodiments of the present invention and modifications, obvious to those skilled in the art can be made thereto, without departing from the scope of the present invention.

The invention claimed is:

1. A lighting device comprising:

a battery housing;

a light housing having a light source that emits light when activated;

a circuit comprising a switch, the circuit coupled to the battery housing and the light source; and wherein the light housing is movable towards the battery housing to motivate the switch to close the circuit and the light housing is movable towards the battery housing to motivate the switch to open the circuit.

2. The lighting device of claim 1, wherein the light source comprises an LED.

3. The lighting device of claim 1, wherein the light source comprises a lamp.

4. The lighting device of claim 1, wherein the light housing comprises a lens assembly.

5. The lighting device of claim 4, wherein the lens assembly comprises a translucent material having a frosted finish.

6. The lighting device of claim 1, wherein the circuit comprises a light detector that controls an intensity of the light source according to ambient light.

7. The lighting device of claim 6, wherein the light detector increases intensity of the light source as the ambient light increases.

8. The lighting device of claim 6, wherein the light detector decreases intensity of the light source as the ambient light increases.

9. The lighting device of claim 1, wherein the battery housing comprises a battery.

10. A lighting device comprising:

a battery housing;

a light housing comprising a light source that emits light when activated;

a circuit comprising a light detector, the circuit coupled to the light source; and wherein the light detector controls an intensity of the light source according to ambient light; and wherein the circuit further comprises a switch and wherein the light housing is movable towards the battery housing to motivate the switch to close the circuit and the light housing is movable towards the battery housing to motivate the switch to open the circuit.

11. A lighting device comprising:

a battery housing;

a light housing comprising a light source that emits light when activated;

a circuit comprising a light detector, the circuit coupled to the light source; and wherein the light detector controls an intensity of the light source according to ambient light; and a base coupled to the battery housing wherein the base includes a recess to receive a mounting spike.

12. A lighting device comprising:

a battery housing;

a light housing comprising a light source that emits light when activated;

a circuit comprising a light detector, the circuit coupled to the light source; and wherein the light detector controls an intensity of the light source according to ambient light; and wherein the light housing further comprises a firstreflector and the second reflector, wherein the first reflector is postioned near the light source and the second reflector is positioned away from the light source.

13. The lighting device of claim 12, wherein the light detector increases intensity of the light source as the ambient light increases.

14. The lighting device of claim 12, wherein the light detector decreases intensity of the light source as the ambient light increases.

15. The lighting device of claim 12, further comprising a base coupled to the battery housing.

16. The lighting device of claim 15, further comprising a foot mounted to the base.

17. A lighting device circuit comprising:

a power source;

a transformer connected to the power source;

a light source;

a transistor circuit connected to the transformer and the light source;

light dependent circuit connected to the transistor circuit and controllably turns the transistor circuit and the light source on and off; and a switch connected to the transistor circuit to activate and deactivate the lighting device circuit according to movement of the light source toward the power source.

18. The lighting device circuit of claim 17, wherein the light dependent circuit comprises a resistor and a light dependent resistor connected in series.

19. The lighting device circuit of claim 17, wherein the light source is a white LED.

20. The lighting device circuit of claim 17, wherein the power source is a battery and the transformer steps up voltage from the battery to illuminate the light source.

* * * * *